US010086311B2

(12) United States Patent
Sakai

(10) Patent No.: US 10,086,311 B2
(45) Date of Patent: Oct. 2, 2018

(54) FUSIBLE TOY BEAD SCRAPER

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 15/672,735

(22) Filed: Aug. 9, 2017

(65) Prior Publication Data

US 2018/0043276 A1 Feb. 15, 2018

(30) Foreign Application Priority Data

Aug. 10, 2016 (JP) ..... 2016-157501
Aug. 23, 2016 (JP) ..... 2016-162324
Jan. 27, 2017 (JP) ..... 2017-012665

(51) Int. Cl.
*A63H 33/14* (2006.01)
*B26B 3/03* (2006.01)

(52) U.S. Cl.
CPC ..... *A63H 33/14* (2013.01)

(58) Field of Classification Search
CPC ..... B26B 3/03; B26B 5/008; B26B 13/22; B26B 27/00; A47L 13/08; A47L 13/022; A47L 13/12; A47L 17/02; A63H 33/00; A63H 33/084
USPC .... 30/169, 355–357, 342, 350, 314; 446/71, 446/76, 168, 170
See application file for complete search history.

(56) References Cited

U.S. PATENT DOCUMENTS 2,791,026 A * 5/1957 Byrd ..... B26B 3/03 30/115
2,807,877 A * 10/1957 Fryer ..... B29C 37/02 30/280
3,328,877 A 7/1967 Brown
4,021,912 A * 5/1977 Stanfield ..... B26B 5/008 157/13
4,457,070 A * 7/1984 Reeves ..... B26B 27/00 30/314
4,779,301 A 10/1988 Millette
2009/0320299 A1 12/2009 Kuhn et al.

FOREIGN PATENT DOCUMENTS

CN 2164964 Y 5/1994
CN 202777814 U 3/2013
CN 203243705 U 10/2013
CN 204687697 U 10/2015
GB A-2549399 10/2017

(Continued)

OTHER PUBLICATIONS

JP Notification of Reasons for Refusal dated Jan. 5, 2017 for JP 2016-162324, including English translation.

(Continued)

*Primary Examiner* — Kien Nguyen
(74) *Attorney, Agent, or Firm* — Drinker Biddle & Reath LLP

(57) ABSTRACT

A fusible toy bead scraper includes: a main body; a spatula portion formed on a rear side of the main body; a support portion provided on the main body and extending obliquely rearward from the main body; and a grip portion provided on the support portion.

11 Claims, 14 Drawing Sheets

(56) References Cited

FOREIGN PATENT DOCUMENTS

| | | | |
|---|---|---|---|
| JP | S56-039680 | Y | 9/1981 |
| JP | S59-002600 | U | 1/1984 |
| JP | H07-158023 | A | 6/1995 |
| JP | 3048620 | U | 5/1998 |
| JP | 2006345754 | A | 12/2006 |
| JP | 3131292 | U | 4/2007 |
| KR | U-2011-0005646 | | 6/2011 |

OTHER PUBLICATIONS

JP Notification of Reasons for Refusal dated Dec. 15, 2016 for JP 2016-157501, including English translation.
KR Office Action dated Dec. 22, 2017 from corresponding Korean patent application No. 10-2017-0100985 (with attached English-language translation).
GB Office Action dated Feb. 8, 2018 from corresponding GB patent application No. 1712856.2.
Chinese Office Action dated Apr. 24, 2018 that issued in Chinese Patent Application No. 201710682359.5, along with its English-language translation attached.

* cited by examiner

FUSIBLE TOY BEAD SCRAPER

CROSS-REFERENCE TO RELATED APPLICATION(S)

This application is based on and claims priority from Japanese Patent Application No. 2016-157501 filed on Aug. 10, 2016, Japanese Patent Application No. 2016-162324 filed on Aug. 23, 2016, and Japanese Patent Application No. 2017-012665 filed on Jan. 27, 2017, the entire contents of which are incorporated herein by reference.

BACKGROUND

1. Field of the Invention

One or more embodiments of the present invention relate to a fusible toy bead scraper to be used for removing, from a holding tray, a plurality of fusible toy beads placed on a holding tray.

2. Description of Related Art

Fusible toy beads using granular or particulate beads made of a water-soluble resin have been provided. Japanese Utility Model Registration No. 3131292 discloses a bead toy set including: a holding tray in which a plurality of recesses are formed to place a fusible toy beads therein; a base tray; and a seat inserted between the holding tray and the base tray. Here, a pattern is drawn on this sheet, and when a user places fusible toy beads on the holding tray in accordance with the pattern, it is possible to create assemblies of the fusible toy beads in various shapes.

For example, this fusible toy bead is formed into a granule or particulate shape by mixing and kneading polyvinyl alcohol with a resin. After placing the fusible toy beads on the holding tray, the surfaces of fusible toy beads are melted or dissolved by supplying water to the fusible toy beads with a spray or the like to place the fusible toy beads in a wet state. Thereafter, when the fusible toy beads are left for a predetermined period of time and dried, the melted resin is cured, and the fusible toy beads are bonded to one another. In this manner, a user, mainly a child, can enjoy creating an assembly of the fusible toy beads in a desired design.

SUMMARY

In supplying water to fusible toy beads, a sufficient amount of water is supplied so that the surfaces of the fusible toy beads can be definitely melted or dissolved. An excessive portion of the water gathers in a concave portion of a holding tray after sufficiently wetting the fusible toy beads. Then, when the fusible toy beads to which the water has been supplied are naturally dried, surfaces of the beads on the upper surface side are first dried, and their surfaces on the under surface side (namely, a side facing the holding tray) are dried more slowly than the surfaces on the upper surface side. Here, each fusible toy bead slightly shrinks when dried and cured. Accordingly, an assembly of the fusible toy beads left on the holding tray to be dried may be completed in a curved state in some cases because its surface on the upper surface side has first dried and shrunk. This may reduce the pleasure of a child playing with the fusible toy beads.

If the fusible toy beads are to be removed with fingers at an early stage before being completely dried in order to prevent the curve of an assembly of the fusible toy beads otherwise occurring after the drying, since the fusible toy beads are not completely bonded to one another, the assembly of the fusible toy beads carefully aligned may come apart in some cases. Alternatively, if the holding tray is turned upside down to remove the assembly of the fusible toy beads therefrom, the water gathered in the concave portion of the holding tray unavoidably scatters. Since the water gathered in the concave portion contains a pasty component, it may be troublesome to wipe up the water. Although tools such as various types of spatulas can be used, it is difficult for a child to successfully insert the front end of the tool such as spatula into the lower side of the fusible toy bead.

An object of one or more embodiments of the present invention is to provide a fusible toy bead scraper with which an assembly of fusible toy beads can be removed from a holding tray at an early stage so as to reduce curve occurring in the assembly of the fusible toy beads after drying.

A fusible toy bead scraper according to an aspect of the present invention includes: a main body; a spatula portion provided on a rear side of the main body; a support portion provided on the main body and extending obliquely rearward from the main body; and a grip portion provided on the support portion.

According to the aspect of the present invention, a fusible toy bead scraper with which an assembly of fusible toy beads can be easily removed from a holding tray even before the elapse of a prescribed time period necessary for sufficiently curing and bonding the assembly of the fusible toy beads placed on the holding tray.

DETAILED DESCRIPTION

Figure 1:
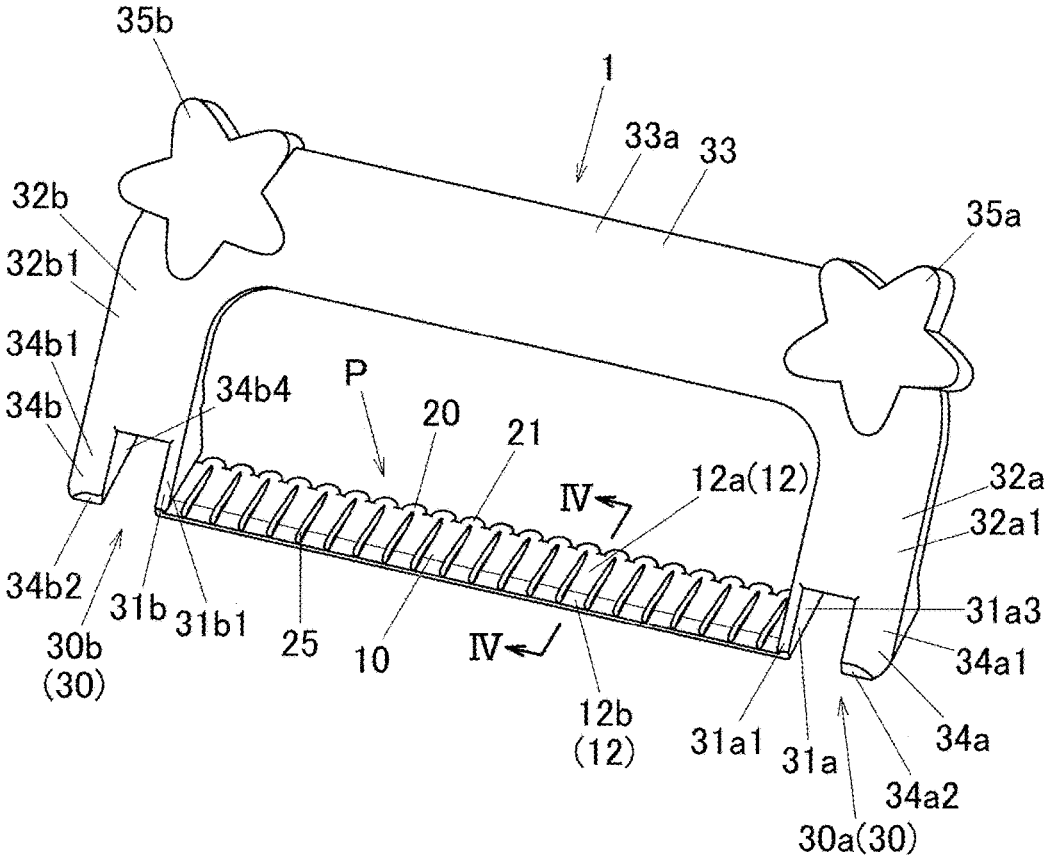
FIG. 1 is a perspective view of a fusible toy bead scraper according to an embodiment of the present invention as viewed from a front side.
Figure 2:
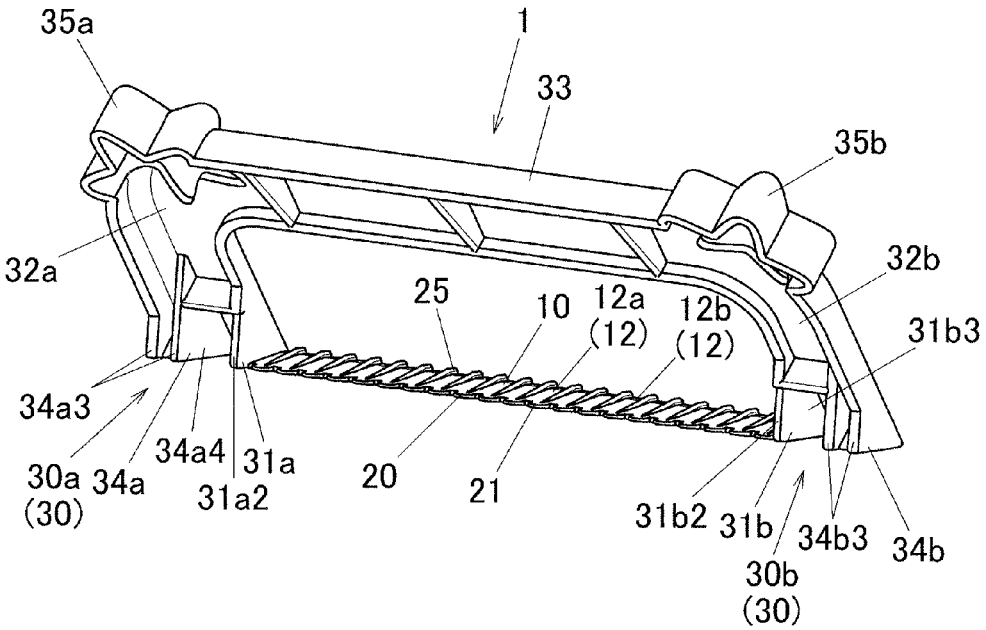
FIG. 2 is a perspective view of the fusible toy bead scraper according to the embodiment of the present invention as viewed from a rear side.
Figure 3:
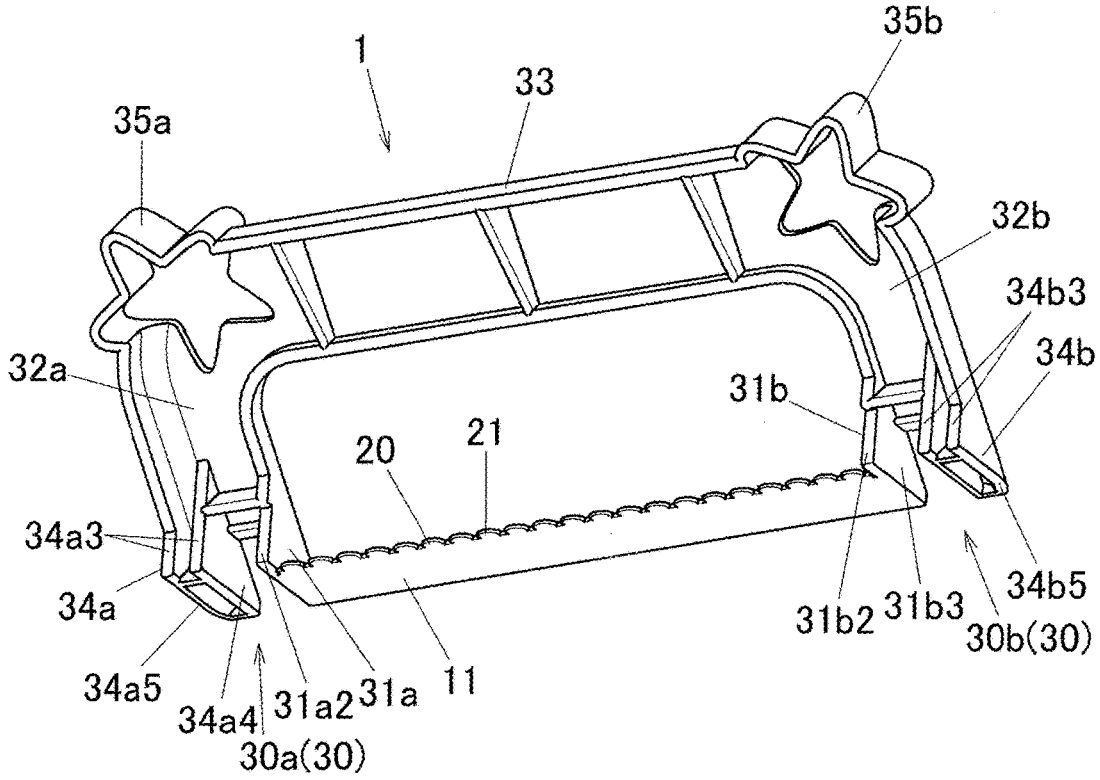
FIG. 3 is a perspective view of the fusible toy bead scraper according to the embodiment of the present invention as viewed obliquely from a rear lower side.

Embodiments of the present invention will be described below with reference to the drawings. FIG. 1 is a perspective view of a fusible toy bead scraper 1 as viewed from the front side. FIG. 2 is a perspective view of the fusible toy bead scraper 1 as viewed from the rear side. FIG. 3 is a perspective view of the fusible toy bead scraper 1 as viewed obliquely from the lower rear side. The fusible toy bead scraper 1 includes a body portion 10 formed in a laterally long and substantially rectangular in plan view. The main body 10 is provided with a spatula portion 20. In the following description, a side of the fusible toy bead scraper 1 opposite to the spatula portion 20 side is referred to as the front side, and a side of the fusible toy bead scraper 1 on the spatula portion 20 side is referred to as the rear side. When viewing the front side from the rear side, the left hand side is referred to as the left side, and the right hand side is referred to as the right side.

The fusible toy bead scraper 1 is placed on the holding tray 50 or 60 shown in FIGS. 6 to 9, etc. When the spatula portion 20 is moved rearward, it is possible to remove the assembly of the fusible toy beads 80 placed on the holding trays 50, 60 in a time shorter than the predetermined time until the assembly of the fusible toy beads 80 is completely cured and bonded.

Figure 4:
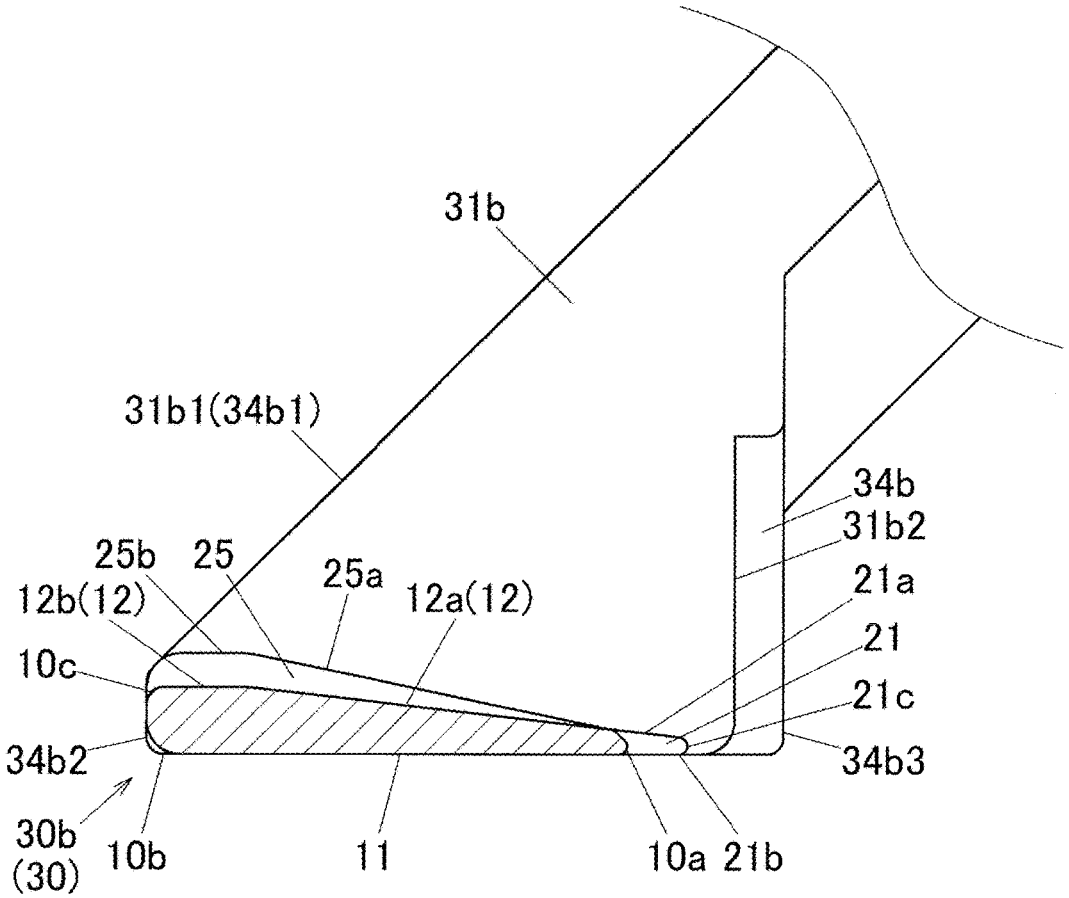
FIG. 4 is a partially enlarged sectional view of the fusible toy bead scraper according to the embodiment of the present invention, taken along a line IV-IV in FIG. 1.

First, the configuration of the fusible toy bead scraper 1 will be described with reference to FIGS. 1 to 5. The main body 10 of the fusible toy bead scraper 1 is formed in a substantially rectangular plate shape which is long in the left and right direction. As shown in FIGS. 3 and 4, the lower surface 11 of the main body 10 is a horizontal flat surface. On the other hand, as shown in FIGS. 1, 2, and 4, the upper surface 12 of the main body 10 includes an inclined surface 12*a* which rises from the rear side to the front side, and a flat surface 12*b* continuous with the inclined surface 12*a* on the front side of the inclined surface 12*a*. The flat surface 12*b* and the lower surface 11 are parallel.

Figure 5:
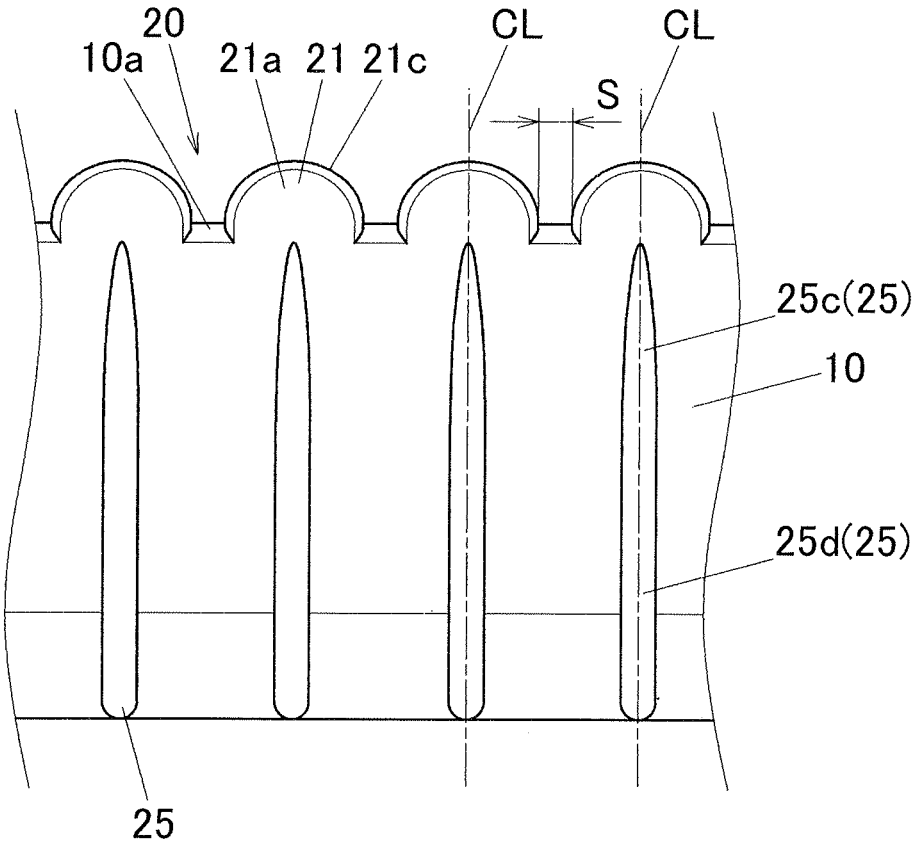
FIG. 5 is a partially enlarged plan view of the fusible toy bead scraper according to the embodiment of the present invention, as viewed from P direction in FIG. 1.

As shown in FIGS. 1 to 3, the spatula portion 20 has a protruding and recessed shape in a plan view. More specifically, as shown in FIG. 5, the spatula portion 20 is formed by arranging a plurality of protruding circular arc portions 21 (protruding portions) at the rear end of the main body 10 at a predetermined intervals S in the left-right direction. The left-right direction in which the plurality of protruding circular arc portions 21 (protruding portions) are arranged is a direction perpendicular to the moving direction of the spatula portion 20 in the same plane. Further, the rear end of the main body 10 between the protruding circular arc portions 21, which is defined as the intervals S, is linearly formed in the left-right direction.

As shown in FIG. 4, the upper surface 21*a* of the protruding circular arc portion 21 is an inclined surface continuing to the inclined surface 12*a* of the upper surface 12 of the main body 10. On the other hand, the lower surface 21*b* of the protruding circular arc portion 21 is a flat surface continuous with the lower surface 11 of the main body 10. The end portion 21*c* of the protruding circular arc portion 21 has an angular R shape in a side view. The end portion 10*a* of the main body 10 at the interval S is formed such that a tip portion having an angular R shape is offset downward. The upper and lower end portions 10*b*, 10*c* of the main body 10 are also formed in an angular R shape. The dimension of the corner R is set to be larger at the lower end portion 10*b* than at the upper end portion 10*c*. Consequently, it is possible to smoothly move the lower surface 11 of the main body 10 placed on the upper surface of the wet holding tray 50 or 60.

As particularly shown in FIGS. 1, 2, 4, and 5, a rib portion 25 which is long in the front-to-rear direction is formed on the upper surface 12 of the main body 10. A plurality of rib portions 25 are arranged in the left-right direction. As shown in FIG. 4, the rib portion 25 is formed so as to protrude upward from the upper surface 12 of the main body 10. The upper surface of the rib portion 25 has an inclined rib portion 25*a* and a flat rib portion 25*b* continuous with the inclined rib portion 25*a* on the front side. The inclined rib portion 25*a* is formed such that the height from the upper surface 12 in the section located on the inclined surface 12*a* gradually increases. The flat rib portion 25*b* is formed to be horizontal such that the height from the upper surface 12 is a predetermined height in the section located on the flat surface 12*b*. The inclined rib portion 25*a* and the flat rib portion 25*b* are rounded when viewed from the front-rear direction.

As shown in FIG. 5, an introduction portion 25*c* is formed at the rear end of the rib portion 25. The introduction portion 25*c* is formed in a tapered shape such that the width in the left-right direction of the rib portion 25 gradually increases in the section from the rear end of the rib portion 25 to about one quarter of the front-rear length of the rib portion 25. A linear portion 25*d* is formed on the front side of the introduction portion 25*c* so as to be continuous with the introduction portion 25*c*. The linear portion 25*d* extends to the front end of the main body 10. In addition, the center line CL in the left-right direction of each rib portion 25 is arranged so as to coincide with the center of each protruding circular arc portion 21 of the spatula portion 20. The number of protruding circular arc portions 21 and the number of the rib portions 25 are the same.

Figure 6:
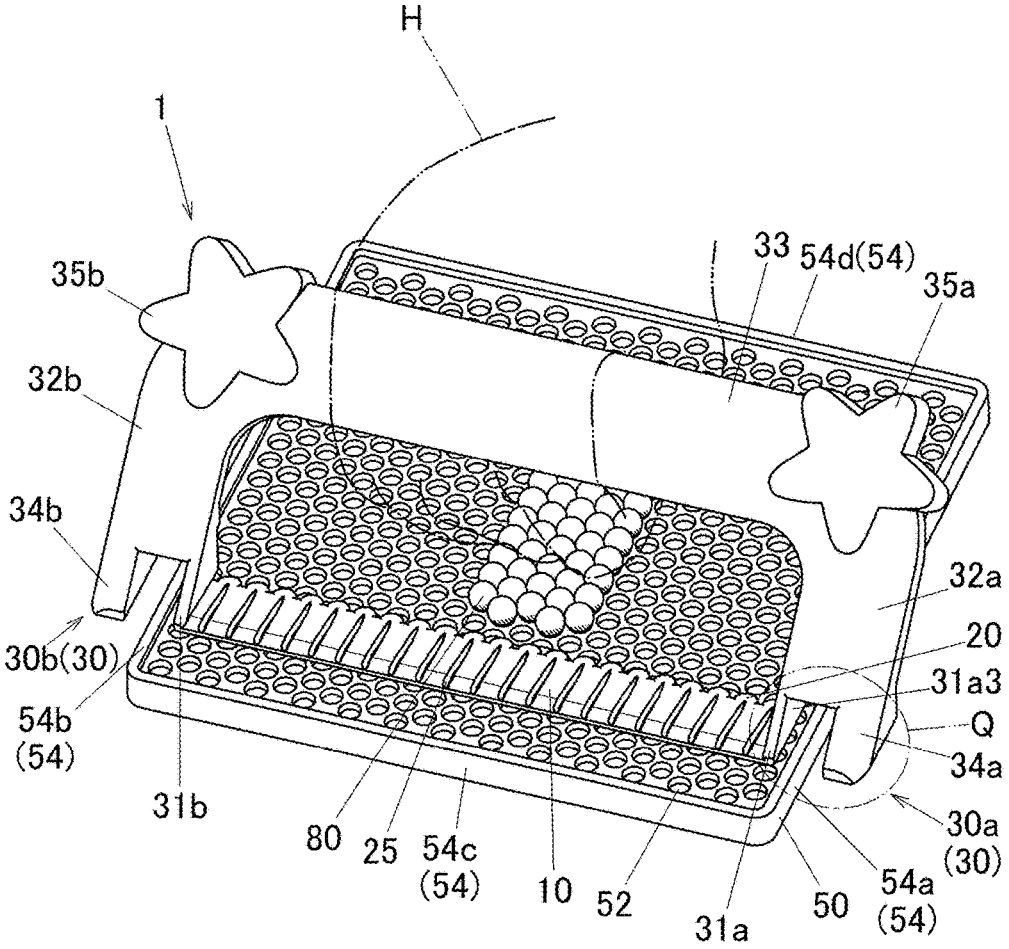
FIG. 6 is a perspective view showing a state in which the fusible toy bead scraper according to an embodiment of the present invention is placed on a holding tray on which an assembly of the fusible toy beads is disposed.
Figure 7:
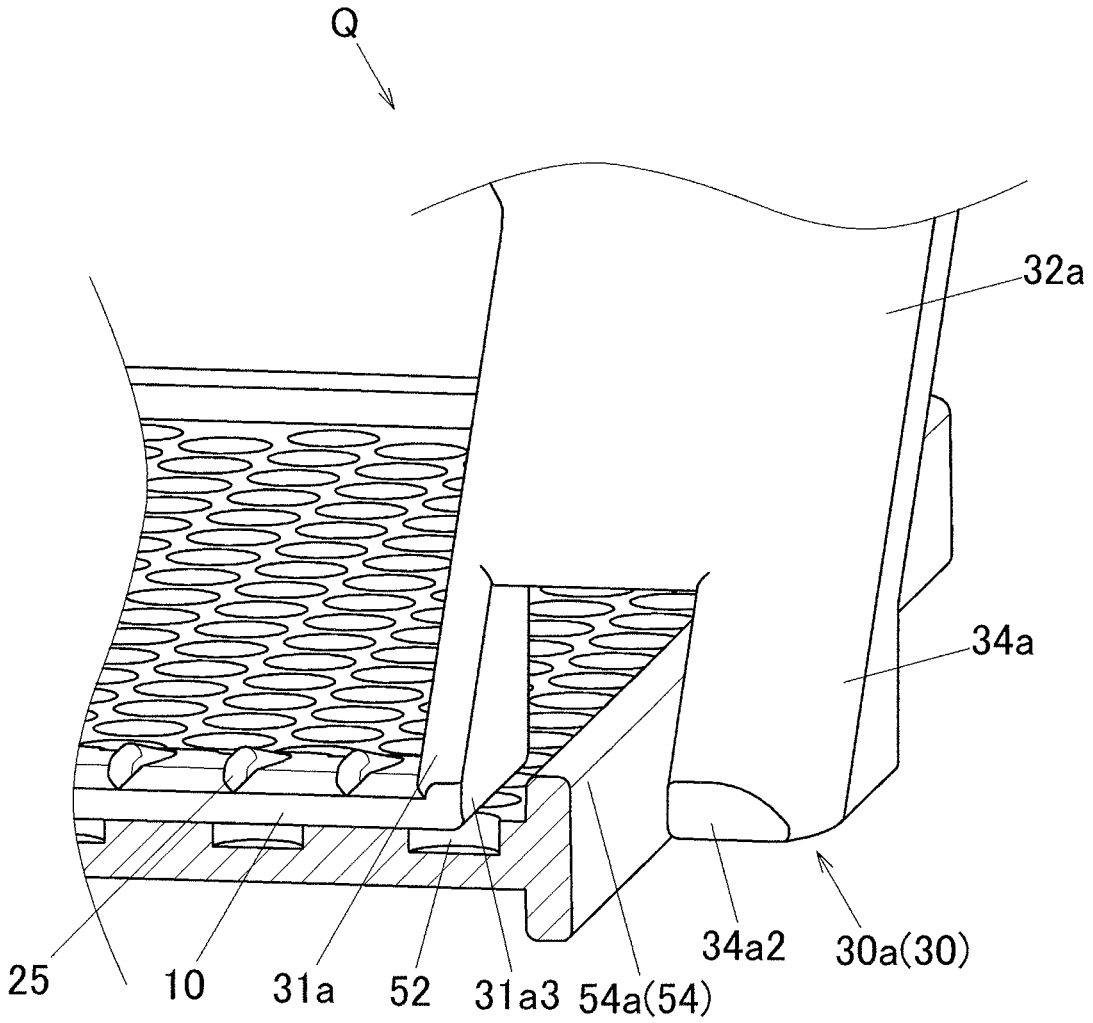
FIG. 7 is a partially enlarged perspective view showing a part of the holding tray in cross section by enlarging the Q portion of FIG. 6 in a state where of the fusible toy bead scraper according to the embodiment of the present invention is placed on the holding tray.

In the present embodiment, the interval between the center lines CL of the rib portions 25 is set to be substantially the same as the diameter of the fusible toy bead 80 shown in FIG. 6. When the distance between the center lines CL is set to be equal to or smaller than the diameter of the fusible toy bead 80, the fusible toy bead 80 can be supported by the rib portion 25 when removing the assembly of the fusible toy beads 80. Consequently, it is possible to reduce the situation in which the lower surface of the fusible toy bead 80 contacts and sticks to the upper surface of the main body 10.

As shown in FIGS. 1 to 3, a guide portion 30 (left guide portion 30*a*, right guide portion 30*b*) is provided on each of the left and right sides of the main body 10 formed as described above. The guide portion 30 guides the movement of the spatula portion 20 of the fusible toy bead scraper 1 on the holding tray 50 or 60.

The left guide portion 30*a* and the right guide portion 30*b* are provided with plate-shaped guide portions 31*a* and 31*b*, respectively. The plate-shaped guide portions 31*a*, 31*b* are formed in a plate shape standing upward from both left and right ends of the main body 10. The plate-shaped guide portions 31*a* and 31*b* are formed into a substantially right-angled triangle shape in a side view in which the front surfaces 31*a*1, 31*b*1 are inclined rearward. As shown in FIGS. 2 to 4 (particularly, FIG. 4), the rear end surfaces 31*a*2 and 31*b*2 of the plate-shaped guide portions 31*a* and 31*b* are located at positions in the front-rear direction to be on a further rear side than the rearmost portions (the end portions 21*c*) of the protruding circular arc portions 21 of the spatula portion 20. Further, as shown in FIG. 3, the lower surfaces of the plate-shaped guide portions 31*a* and 31*b* are flat surfaces continuous with the lower surface 11 of the main body 10.

As shown in FIGS. 1 to 3, block-shaped guide portions 34*a* and 34*b* are provided on the outside of the outside surfaces 31*a*3 and 31*b*3 of the plate-shaped guide portions 31*a* and 31*b*,respectively, with predetermined gaps therebetween. The block-shaped guide portions 34*a* and 34*b* are also formed in a block shape having a substantially right-angled triangle shape in a side view in which the front surfaces 34*a*1 and 34*b*1 are inclined rearward. The outer side surfaces of the front faces 34*a*1 and 34*b* have protruding circular arc shapes when viewed from the front-rear direction. The front ends of the block-shaped guide portions 34*a* and 34*b* include flat portions 34*a*2 and 34*b*2 chamfered in the vertical direction. The rear surfaces 34*a*3 and 34*b*3 of the block-shaped guide portions 34*a* and 34*b* are located on the further rear side than the rear end surfaces 31*a*2 and 31*b*2 of the plate-shaped guide portions 31*a* and 31*b* (see also FIG. 4). As shown particularly in FIGS. 3 and 4, the lower surfaces 34*a*5 and 34*b*5 of the block-shaped guide portions 34*a* and 34*b* are positioned on the same plane as the lower surface 11 of the main body 10.

As shown in FIG. 1, the plate-shaped guide portions 31*a* and 31*b* and the block-shaped guide portions 34*a* and 34*b* are connected by support portions 32*a* and 32*b* located above the plate-shaped guide portions 31*a* and 31*b*. Each of the support portions 32*a* and 32*b* is formed into a wide plate-like shape. The front surfaces 31*a*1 and 31*b*1 of the plate-shaped guide portions 31*a* and 31*b*,the front surfaces 34*a*1 and 34*b*1 of the block-shaped guide portions 34*a* and 34*b*, and the front surfaces 32*a*1 and 32*b*1 of the support portions 32*a* and 32*b* form a continuous surface. Accordingly, the front surfaces 32*a*1 and 32*b*1 of the support portions 32*a* and 32*b* extend to be rearwardly inclined similar to the front surfaces 31*a*1 and 31*b* 1 of the plate-shaped guide portions 31*a* and 31*b* and the front surfaces 34*a*1 and 34*b*1 of the block-shaped guide portions 34*a* and 34*b*.

A grip portion 33 is formed across the support portions 32*a* and 32*b* so as to connect the upper end portions of the support portions 32*a* and 32*b* to each other. The grip portion 33 is formed in a substantially wide plate shape, and the front surface 33*a* thereof is formed by a surface which is continuous with the front surfaces 31*a*1 and 31*b*1 of the plate-shaped guide portions 31*a* and 31*b*,the front surfaces 34*a*1 and 34*b*1 of the block-shaped guide portions 34*a* and 34*b*,and the front surfaces 32*a*1 and 32*b*1 of the support portions 32*a* and 32*b*. Similar to the front surfaces 32*a*1 and 32*b*1 of the support portions 32*a* and 32*b*,the front surfaces 31*a*1 and 31*b*1 of the plate-shaped guide portions 31*a* and 31*b*,and the front surfaces 34*a*1 and 34*b*1 of the block-shaped guide portions 34*a* and 34*b*, the front surface 33*a* of the grip portion 33 extends obliquely rearward. The position in the vertical direction of the grip portion 33 is higher than the spatula portion 20, and the position in the front-rear direction of the grip portion 33 is located sufficiently behind the spatula portion 20. Star decorative portions 35*a* and 35*b* are formed on both right and left ends of the grip portion 33 (that is, connection portions between the support portions 32*a* and 32*b* and the grip portion 33).

The grip portion 33 and the support portions 32*a* and 32*b* are formed in a substantially shell shape, and are provided with thinned portion in the resin molding as appropriate, and ribs are appropriately formed on the inner side of each shell shape. In addition, the interior of the block-shaped guide portions 34*a* and 34*b* is also subjected to formation of the thinned portion to form a space portion.

The fusible toy bead scraper 1 can be placed on the holding tray 50 shown in FIG. 6, for example. In the holding tray 50, a plurality of spherical fusible toy beads 80 are placed and arranged. Here, a well-known fusible toy bead 80 is used. For example, the fusible toy bead 80 is formed by mixing and kneading polyvinyl alcohol with a resin. In this embodiment, a spherical shape is shown as the shape of the fusible toy bead 80. However, a polyhedron shape or the like may also be used. It is also possible to use fusible toy beads 80 of various colors.

In addition, any of known holding trays may be used as the holding tray 50 together with the fusible toy beads 80. The holding tray 50 is formed in a substantially square plate shape in plan view. On the surface of the holding tray 50, a plurality of circular recesses 52 are provided. The recesses 52 are arranged to be offset in different rows (or columns). In this way, six fusible toy beads 80 can be radially placed on the recess 52 around and adjacent to one fusible toy bead 80 placed in the recess 52. The diameter of the recess 52 is formed to be smaller than the diameter of the fusible toy bead 80, and the distance between the centers of the adjacent recesses 52 is set such that the fusible toy beads 80 arranged in the adjacent recesses 52 contact each other or slightly spaced from each other. Incidentally, the other known holding trays include one in the shape of a circle or the like, and one having the recesses 52 disposed not to be offset but in parallel.

Further, a wall-shaped edge wall portion 54 is formed on the four outer peripheral edges of the holding tray 50. Specifically, the edge wall portion 54 includes a left edge wall portion 54*a*, right edge wall portion 54*b*, a front edge wall portion 54*c*, and a rear edge wall portion 54*d* which are formed to be linked to one another and to form round corners. The distance between the surfaces of opposing edge wall portions 54 (for example, the distance between the inner side surface of the left side wall portion 54*a* and the inner side surface of the right side wall portion 54*b*) is set slightly larger than the distance between the outer surfaces 31*a*3 and 31*b*3 of the plate-shaped guide portions 31*a* and 31*b* of the fusible toy bead scraper 1. In other words, the plate-shaped guide portions 31*a* and 31*b* are disposed in the vicinity of the inner side surfaces of the edge wall portions 54 (the left edge wall portion 54*a* and the right edge wall portion 54*b*) opposing the outer surfaces 31*a*3 and 31*b*3.

Figure 8:
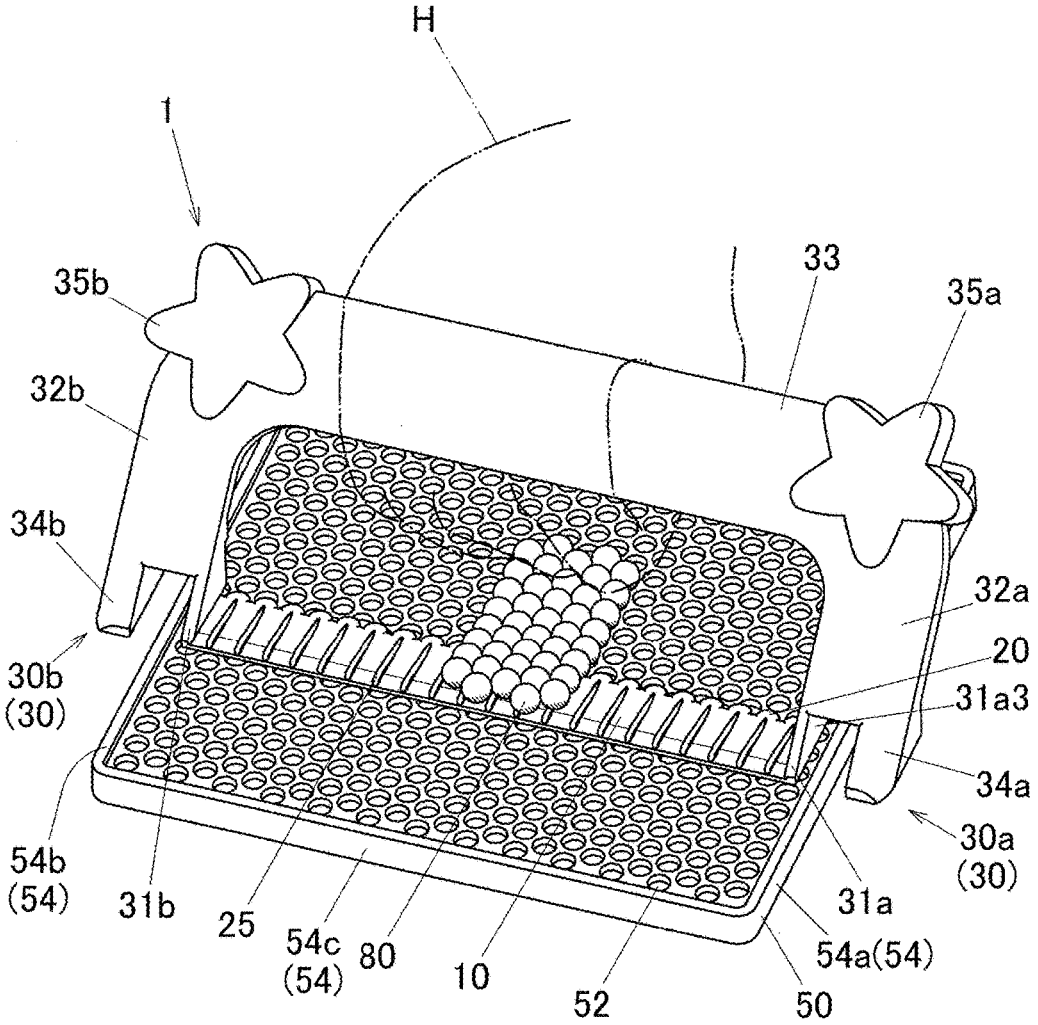
FIG. 8 is a perspective view showing a state during which the fusible toy bead scraper according to the embodiment of the present invention is placed on the holding tray and moved rearward to remove the assembly of the fusible toy beads from the holding tray.

In the plurality of fusible toy beads 80 placed on the holding tray 50, when a predetermined time (for example, about 30 minutes to 60 minutes) elapses from supply of water by spraying or the like to curing and bonding, the fusible toy beads 80 in a wet state are dried, and the molten fusible toy beads 80 are bonded to each other and cured. Removal of the assembly of the fusible toy beads 80 by the fusible toy bead scraper 1 from the holding tray 50 is performed at a time (for example, about 20 minutes) shorter than the predetermined time until the fusible toy bead 80 is hardened and bonded. The state of the fusible toy bead 80 in a time shorter than the predetermined time until the fusible toy bead 80 is cured and bonded is that the exposed upper surface of the plurality of fusible toy beads 80 has already started to be cured but the surface of the fusible toy beads 80 on the side of the recesses 52 of the holding tray 50 is still in a wet state. The assembly of the fusible toy beads 80 in this state is such a state that it separates when pulled by applying a certain amount of force by hand. In FIGS. 6 and 8, the hatched portions of the fusible toy beads 80 show those in a wet state.

Next, the procedure for removing the assembly of the fusible toy beads 80 from the holding tray 50 with the fusible toy bead scraper 1 will be described. After water is supplied to the assembly of the fusible toy bead 80 placed on the holding tray 50, and then a time (for example, 15 minutes to 20 minutes) shorter than the predetermined time until the assembly of the fusible toy beads 80 is hardened and bonded elapses, the fusible toy bead scraper 1 is placed on the holding tray 50. As shown in FIG. 6, the position where the fusible toy bead scraper 1 is placed on the holding tray 50 is on the front side of the assembly of fusible toy beads 80. Here, the user sits on the back side of the fusible toy bead scraper 1. In FIGS. 6 and 8, the hand of the user is denoted by symbol H. The user grasps the grip portion 33 of the fusible toy bead scraper 1 with the hand H and pulls the fusible toy bead scraper 1 from the front side to the rear side to move the fusible toy bead scraper 1 rearward.

When the fusible toy bead scraper 1 moves rearward, the outer side surfaces 31*a*3 and 31*b*3 of the plate-shaped guide portions 31*a* and 31*b* are guided to the inner side surfaces of the left side wall portion 54*a* and the right side wall portion 54*b*. Since the position of the grip portion 33 is located above the position of the spatula portion 20 and sufficiently rearward of the position of the spatula portion 20, the lower surface 11 of the main body 10 entirely contacts the placement surface of the tray 50, or the front side of the lower surface 11 separates from the placement surface of the holding tray 50 and tilts slightly backward. Consequently, the tip of the spatula portion 20 enters the lower end portion of the fusible toy bead 80.

Furthermore, since the spatula portion 20 has a protruding and recessed shape in a plan view having a plurality of protruding circular arc portions 21, for the entire fusible toy beads 80 or a part of fusible toy beads 80 adjacent to one another, is is possible to insert the distal end portion of each of the protruding circular arc portions 21 into the space below the portion where the fusible toy beads 80 are bonded in contact with each other or close proximity to each other. Further, by the introduction portions 25*c* at the tip of the plurality of rib portions 25, the fusible toy bead 80 positioned between the adjacent rib portions 25 is gradually delivered onto the inclined rib portions 25*a* of the adjacent rib portions 25. At this time, the wet lower surfaces of the plurality of fusible toy beads 80 are initially in contact with the upper surface 12 (the distal end portion of the inclined surface 12*a*) of the main body 10, but gradually separated from the upper surface 12 (the inclined surface 12*a*) of the main body 10. In this way, the assembly of the fusible toy bead 80 can be removed from the holding tray 50 as shown in FIG. 8.

The removed assembly of the fusible toy beads 80 can be turned upside down by the user's hand such that the lower side of each fusible toy bead 80 in a wet state is on the upper side, and then put on a desk or the like. Since the wet surface of the fusible toy bead 80 becomes on the front surface side, the curing of the wet state surface is promoted more than the surface on the hardening progress side. Therefore, the assembly of the fusible toy beads 80 is hardened substantially evenly rather than cured while it is placed on the holding tray 50. Therefore, warpage of the assembly of the fusible toy beads 80 due to the one side of the assembly of the fusible toy beads 80 being cured and shrinking first is reduced.

Further, according to the above procedure, it is possible to remove the assembly of the fusible toy beads 80 from the holding tray 50 earlier than the timing of completely curing the assembly of the fusible toy beads 80 on the holding tray 50. Therefore, the user can start preparing an assembly of the next fusible toy bead 80 more quickly.

When the fusible toy bead scraper 1 continues to move rearward, the rear end surfaces 31*a*2 and 31*b*2 of the plate-shaped guide portions 31*a* and 31*b* contacts the inner side surface of the rear edge wall portion 54*d*,whereby the tip of the spatula portion 20 does not contact the inner side surface of the rear edge wall portion 54*d*. Therefore, even if a child as a user mistakenly moves the fusible toy bead scraper 1 rearward too much, it is possible to reduce the risk of damaging the tip end portion of the spatula portion 20 formed to have a small thickness by colliding with the inner surface of the rear edge wall portion 54*d*.

Figure 9:
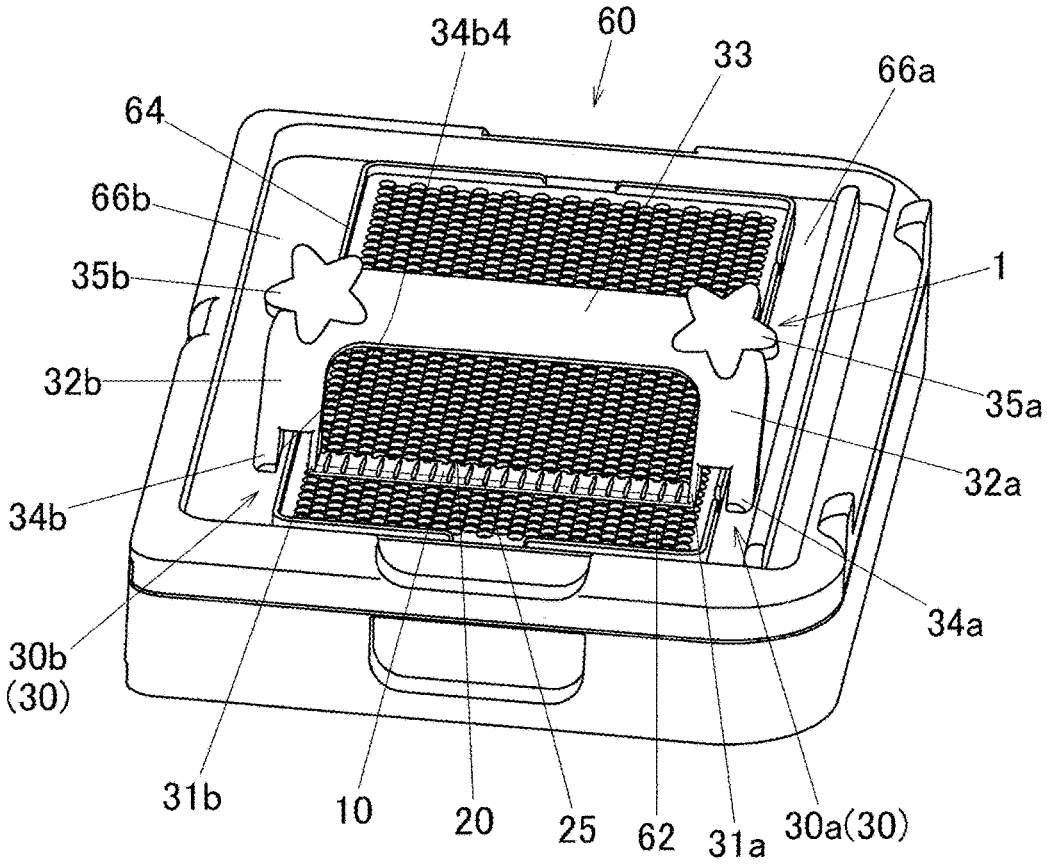
FIG. 9 is a perspective view showing a state in which the fusible toy bead scraper according to the embodiment of the present invention is placed on a holding tray of another embodiment.

Further, as shown in FIG. 9, the fusible toy bead scraper 1 can also be used for a holding tray 60 which is larger than the above-described holding tray 50. The holding tray 60 is provided with a plurality of recesses 62 similar to the recesses 52 of the holding tray 50 described above. On the outer periphery of the plurality of recesses 62, an edge wall portion 64 stands upward in a wall shape. Here, in the upper surface of the holding tray 60, the side upper surfaces 66*a* and 66*b* are formed on the outer side of the left and right edge wall portions 64 so as to be lower than the surface on which the plurality of recesses 62 are formed (in other words, the surface on which the lower surface 11 of the main body 10 is placed).

Also in the plurality of recesses 62 of the holding tray 60, a plurality of fusible toy beads 80 can also be arranged in an arbitrary pattern. Then, similarly to the above-described procedure, the assembly of the fusible toy bead 80 can be removed from the holding tray 60.

Here, the outer surface of the edge wall portion 64 extending in the front-rear direction of the edge wall portion 64 and the inner surfaces 34*a*4 and 34*b*4 of the block-shaped guide portions 34*a* and 34*b* are positioned so as to face each other, and guide the movement of the fusible toy bead scraper 1. Therefore, when the fusible toy bead scraper 1 is moved rearward, it is possible to move the spatula portion 20 rearward while the fusible toy bead scraper 1 is stabilized by the inner surfaces 34*a*4 and 34*b*4 of the block-shaped guide portions 34*a* and 34*b* and the outer surface of the edge wall portion 64.

According to the embodiment of the present invention as described above, it is possible to provide a fusible toy bead scraper of the following aspect.

A fusible toy bead scraper according to a first aspect of the present invention includes: a main body; a spatula portion provided on a rear side of the main body; a support portion provided on the main body and extending obliquely rearward from the main body; and a grip portion provided on the support portion.

According to this configuration, the user sits on the back side of the fusible toy bead scraper, and operates the fusible toy bead scraper so as to pull the fusible toy bead scraper, whereby it is possible to perform a work for removing an assembly of the fusible toy beads from the holding tray. Therefore, since the operation of the fusible toy bead scraper is a pulling operation, the fusible toy bead allows easy removing work even for a child.

Further, the assembly of fusible toy beads can be removed from the holding tray in a time shorter than the predetermined time until the assembly of fusible toy beads is cured and bonded. Therefore, it is possible to reduce the warpage of the assembly of the fusible toy bead due to the shrinkage upon curing, and furthermore, to fabricate a next assembly of the fusible toy beads quickly.

In the fusible toy bead scraper according to the second aspect, the spatula portion has a protruding and recessed shape in plan view.

According to this configuration, with respect to the assembly of the fusible toy beads such as spherical beads, the spatula portion having the protruding and recessed shape in plan view reliably enters the lower side of the assembly of the fusible toy beads, whereby the assembly of fusible toy beads can be removed from the tray easily.

In the fusible toy bead scraper according to the third aspect, the protruding and recessed shape of the spatula portion in plan view has an arc shape.

According to this configuration, since there is no sharp point even when the tip of the spatula portion having the protruding and recessed shape in plan view is touched with a hand, it is possible to provide a fusible toy bead scraper which makes the handling easier.

In the fusible toy bead scraper according to the fourth aspect, the protruding and recessed shape shape of the spatula portion in plan view includes a plurality of protruding portions arranged at predetermined intervals.

According to this configuration, by appropriately setting the predetermined interval between the protruding portions in accordance with the diameter of the fusible toy bead, the tip of the protruding portions can be inserted into the space below the contact portions of the fusible toy beads. Consequently, since the fusible toy bead can be smoothly guided on the upper surface of the main body, it is possible to more easily perform the work of removing the assembly of the fusible toy beads.

In the fusible toy bead scraper according to the fifth aspect, the grip portion extends horizontal from an upper end of the support portion or in the vicinity thereof and is provided substantially parallel to the main body.

According to this configuration, when grasping the grip portion positioned at the rear upper side of the main body and moving the fusible toy bead scraper, since the grip portion and the main body are parallel to each other, the assembly of the fusible toy beads can be easily removed by pulling operation such that the main body, that is, the whole of the spatula portion uniformly contacts the upper surface of the holding tray.

In the fusible toy bead scraper according to the sixth aspect, the support portion is provided on each of left and right sides of the main body and extends obliquely rearward, and the grip portion is provided across the left and right support portions.

According to this configuration, since both ends of the grip portion are connected and fixed to both ends of the main body, the whole of the spatula portion is uniformly brought into contact with the upper face of the holding tray by the strength of the force applied to the left and right end portions of the grip portion, and by the pulling operation, it is possible to provide a fusible toy bead scraper which can allow a child to perform removal work.

In the fusible toy bead scraper according to the seventh aspect, a guide portion configured to guide movement of the spatula portion in a front-rear direction is provided on each of left and right sides of the main body or at least one end of the main body.

According to this configuration, since the movement of the spatula portion is guided in a stable manner, it is possible to remove the assembly of fusible toy beads from the holding tray more reliably.

In the fusible toy bead scraper according to the eighth aspect, a plurality of rib portions are provided on an upper surface of the main body.

According to this configuration, since the fusible toy bead removed by the spatula portion is positioned on the rib portion so as to be supported by the adjacent rib portions, the assembly of the fusible toy beads is supported by the rib portions. Therefore, it is possible to smoothly remove the assembly of the fusible toy beads from the holding tray without the situation in which the lower surface of the fusible toy bead in a wet state sticks to the upper surface of the main body.

In the fusible toy bead scraper according to the ninth aspect, the plurality of rib portions are formed in a front-rear direction or a left-right direction.

According to this configuration, in a case in which the rib portions are formed in the front-rear direction, when the assembly of the fusible toy beads rides on the main body and is separated from the holding tray, the sliding operation of the fusible toy bead scraper in the front-rear direction can be performed smoothly. In a case in which the rib portions are formed in the left-right direction, since each fusible toy bead can be reliably brought into contact with the rib portion, it is possible to introduce and reliably separate the assembly of the fusible toy beads upward from the holding tray.

In the fusible toy bead scraper according to the tenth aspect, the rib portion is formed such that a height from a surface of the main body increases toward a direction away from the spatula portion.

According to this configuration, it is possible to surely separate the assembly of the fusible toy beads from the holding tray by preventing the assembly of the fusible toy beads from adhering to the main body. Further, since the fusible toy bead is separated so as to gradually separate from the holding tray, the user can easily perform subsequent handling such as picking up the assembly of the fusible toy beads after separation by hand.

In the fusible toy bead scraper according to the eleventh aspect, the rib portion comprises an introduction portion which is formed in a front-rear direction and has a width gradually increasing from a spatula portion side.

According to this configuration, since the assembly of the fusible toy beads removed at the spatula portion can be gradually moved from the upper surface of the main body toward the upper surface side of the rib portion via the upper surface of the spatula portion, it is possible to easily remove the assembly of the fusible bead toys from the holding tray.

In the fusible toy bead scraper according to the twelfth aspect, the spatula portion has a protruding and recessed shape in plan view, each of the plurality of rib portion are formed to have an elongated shape in a front-rear direction, and the plurality of the rib portions are arranged in a left-right direction, and a center of each of protruding portions in the protruding and recessed shape is aligned with a center of each of the plurality of rib portions.

According to this configuration, since the longitudinal direction of the rib portion can be arranged corresponding to the spatula portion which is to be moved in the front-rear direction, the assembly of the fusible toy beads which moves in the front-rear direction relatively to the spatula portion can be smoothly supported on the rib portions.

Although the embodiments of the present invention have been described above, the present invention is not limited to the above-described embodiments, and various modifications are possible without departing from the scope of the invention. In FIGS. 10A to 14B described below, the same reference numerals are given to the same members and portions as those of the above-described embodiment, and the description thereof will be omitted or simplified.

Figure 10A:
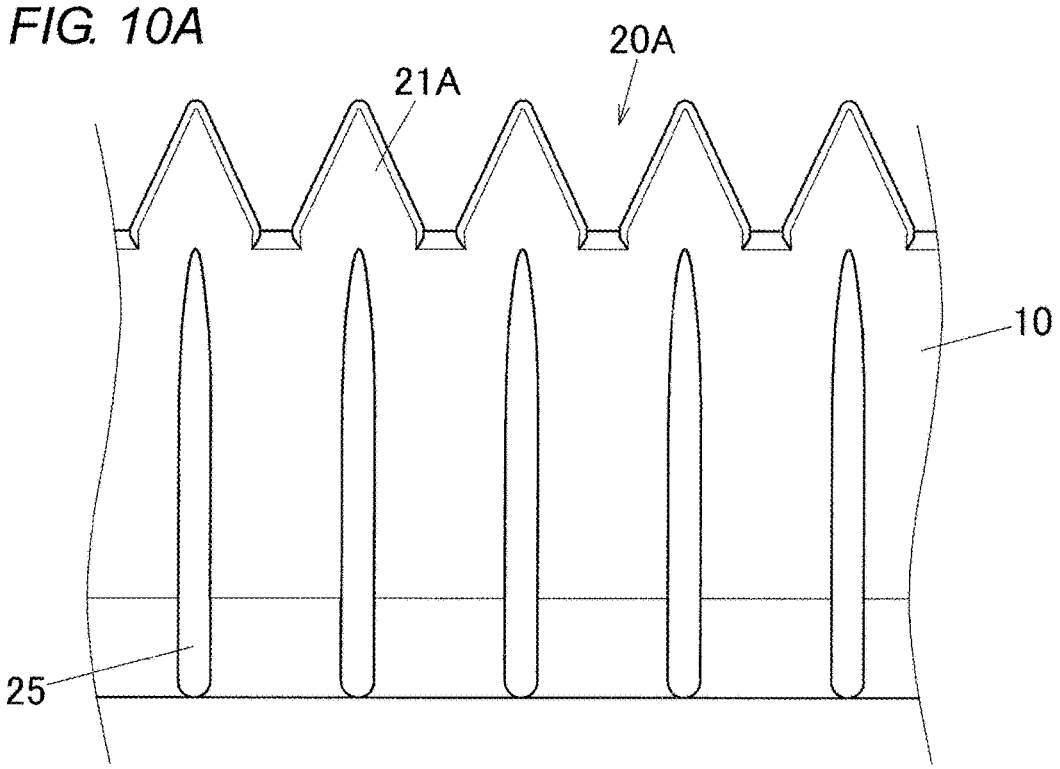
FIGS. 10A and 10B are partial enlarged plan views showing modified examples of a protruding and recessed shape in plan view of the spatula portion of the fusible toy bead scraper according to the embodiment of the present invention.
Figure 10B:
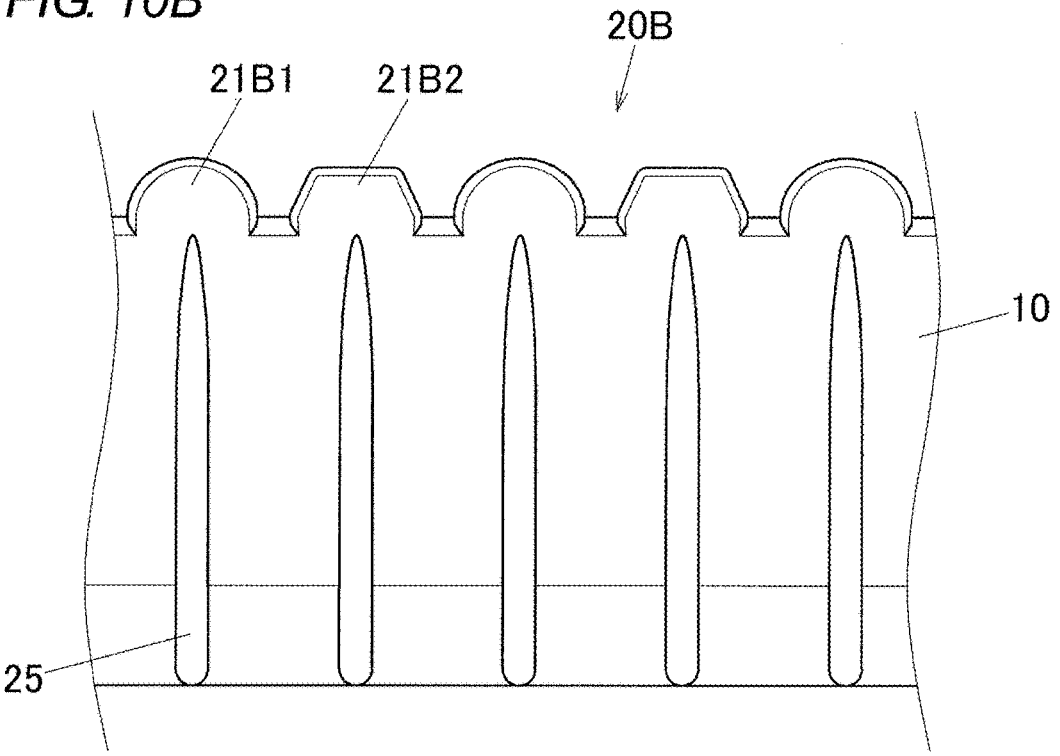

The shape of the spatula portion 20 is not limited to the protruding and recessed shape in plan view having the protruding circular arc portions 21 which are arranged continuously, but may be an appropriate shape. For example, the spatula portion may be a spatula portion 20A having a protruding and recessed shape in a plan view having triangular shapes 21A arranged continuously as shown in FIG. 10A. Further, as shown in FIG. 10B, the spatula portion may be a spatula portion 20B having a protruding and recessed shape in plan view having protruding circular arc portions 21B1 and trapezoid shapes 21B2 are alternately arranged. Besides this, the protruding and recessed shape of the spatula portion 20 in plan view can be formed into various protruding and recessed shapes in plan view such as corrugated shape, various irregular shapes that are not uniform, and the like. At this time, it is preferable that the positions in the front-rear direction of the tip portion in each protruding and recessed shape are substantially the same.

Figure 11:
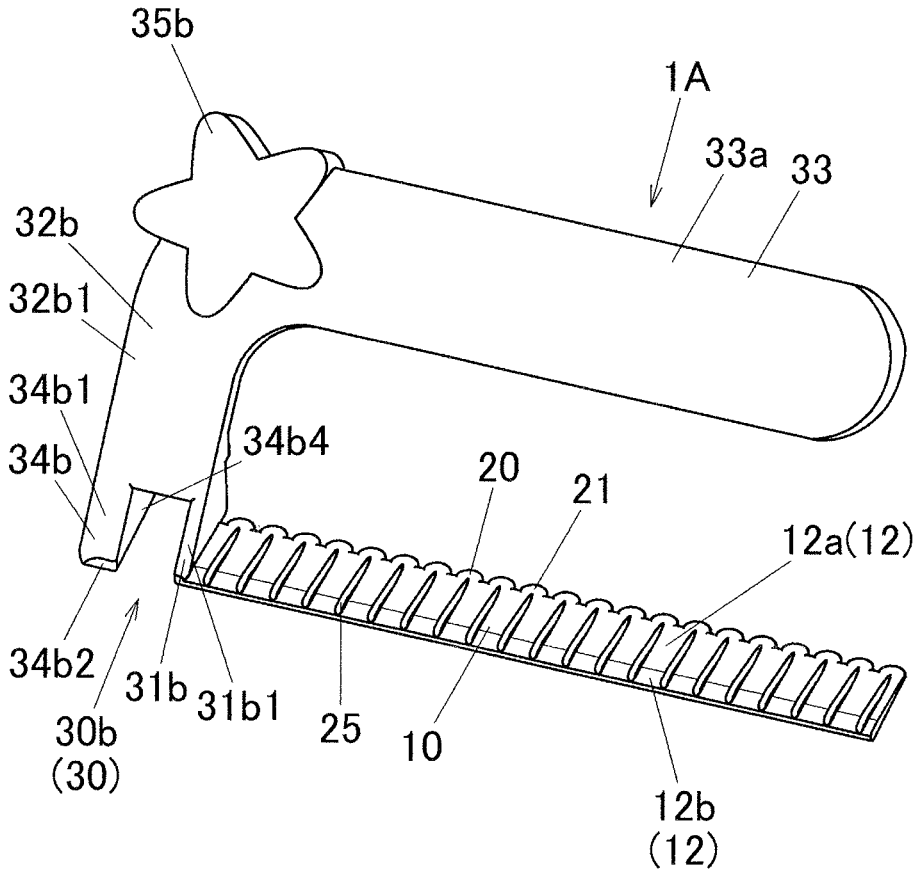
FIG. 11 is a plan view showing a modified example of the grip portion of the fusible toy bead scraper according to the embodiment of the present invention.

Further, the support portion 32 is not limited to the case of being provided at each of the left and right ends of the main body 10. As shown in FIG. 11, the block-shaped guide portion 34*b* and the support portion 32*b* may be provided at one end portion of the main body 10.

In the modification of the embodiment showing the fusible toy bead scraper 1A, the main body 10 including the rib portions 25 on the upper surface 12 and the spatula portion 20 having a protruding circular arc portions 21 having the same number of the rib portion 25 at the rear end is similar to the main unit 10 shown in FIG. 1 and the like, but the fusible toy bead scraper 1A includes the plate-shaped guide unit 31*b* at one end of the main body 10. Connecting the block-shaped guide portions 34*b* separated by a predetermined interval by the support portions 32*b* is similar to the guide portion 30*b* and support portion 32*b* shown in FIG. 1 and the like. Furthermore, in this embodiment, the grip portion 33 that is substantially parallel to the main body 10 is provided horizontally from the upper end of the support portion 32*b* such that the fusible toy bead scraper 1A can be easily grasped and moved.

In the fusible toy bead scraper 1A shown in FIG. 11, the plate-shaped grip portion 33 protrudes horizontally from the upper end of the support portion 32*b*. However, the upper end of the support portion 32*b* may be positioned above the grip portion 33 so as to allow the decorative portion 35*b* to be attached to the upper end of the support portion 32*b*,and the grip portion 33 may protrude horizontally from the intermediate position in the vicinity of the upper end of the support portion 32*b*. Further, the grip portion 33 is not limited to the case of having a plate-like shape as shown in FIG. 11 horizontally protruding from the supporting portion 32*b*,but may be a spherical grip portion 33 provided at the upper end of the supporting portion 32*b* and formed by an bulged portion at the upper end of the supporting portion 32*b* so as to allow the child to grasp it with a hand.

Figure 12:
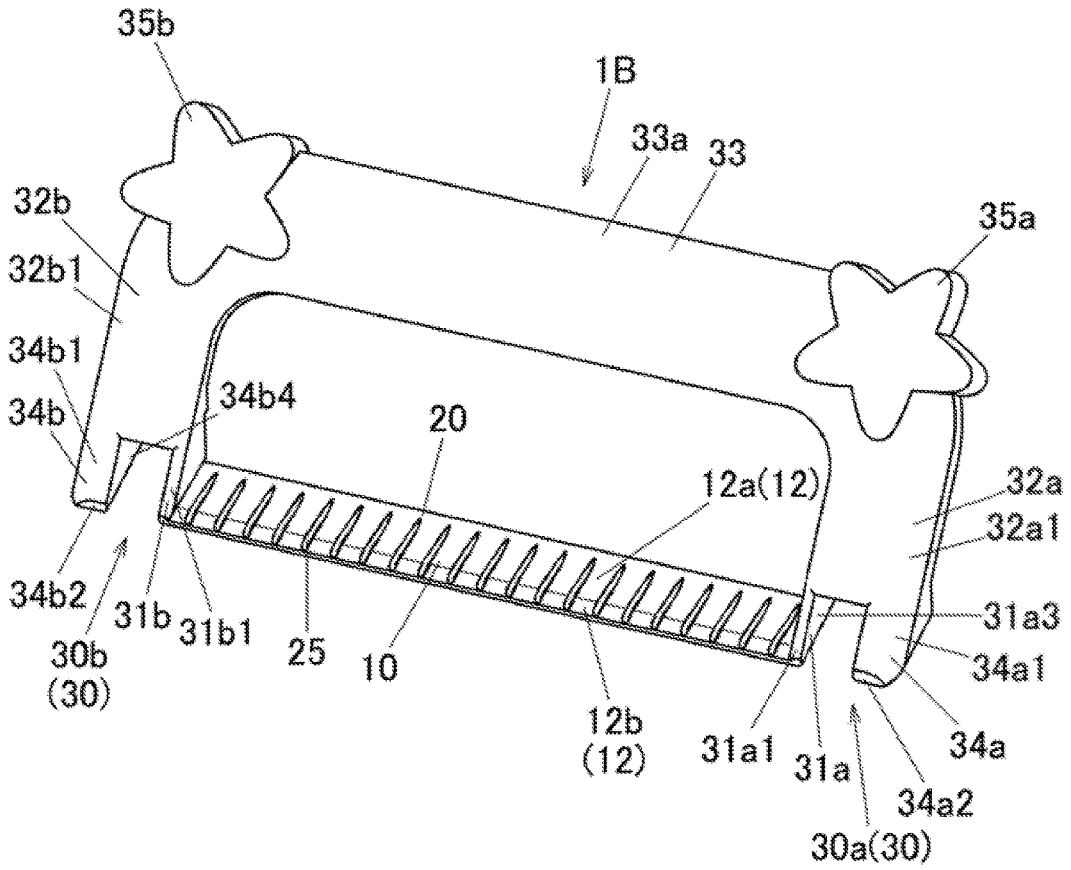
FIG. 12 is a perspective view of a modified example of the spatula portion of the fusible toy bead scraper according to the embodiment of the present invention as viewed from the front side.
Figure 13:
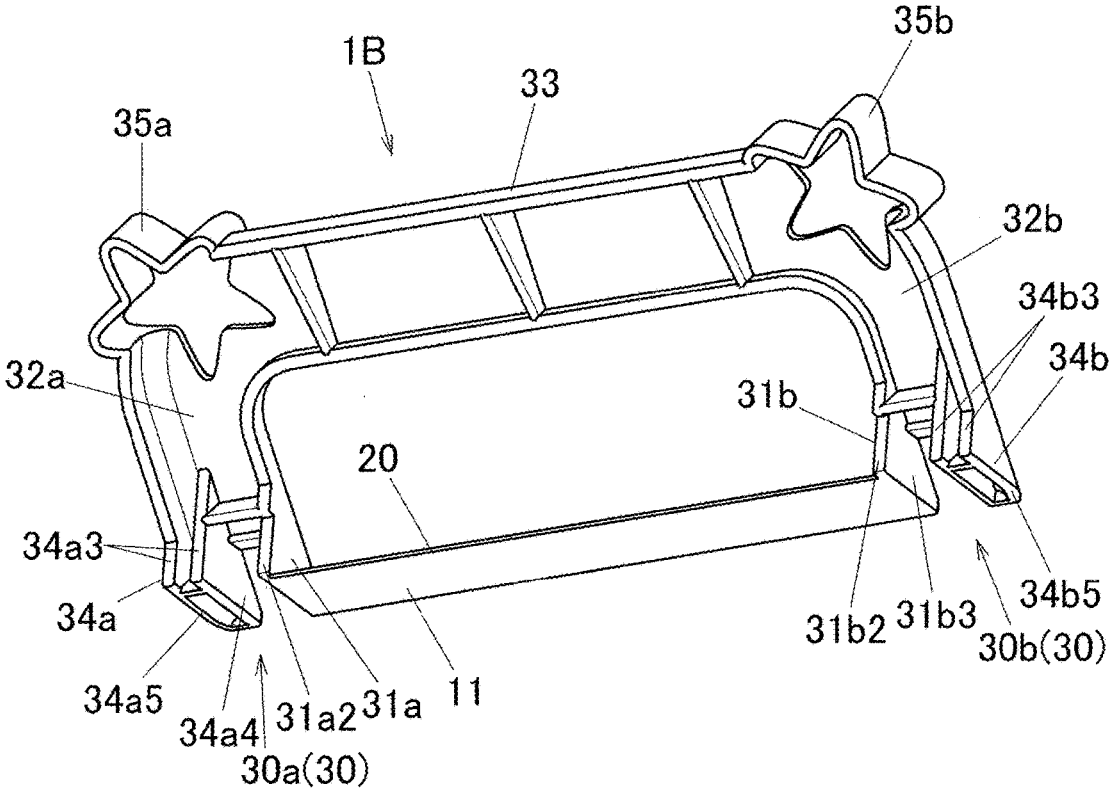
FIG. 13 is a perspective view of a modified example of the spatula portion of the fusible toy bead scraper according to the embodiment of the present invention as viewed from obliquely from a rear lower side.

Further, as shown in FIGS. 12 and 13, the spatula portion 20 may be formed into a linear shape in a plan view not having a protruding and recessed shape. In this fusible toy bead scraper 1B, the right-left direction in which the spatula portion 20 is formed is a direction perpendicular to the moving direction of the spatula portion 20 in the same plane.

The introduction portion 25*c* is formed at the rear end of the rib part 25 provided on the upper surface of the main body 10, and the linear portion 25*d* is formed on the front side of the introduction portion 25*c* so as to be continuous with the introduction portion 25*c* and extends up to the front end of the main body 10. This structure is similar to the embodiment shown in FIG. 1 and the like.

In the present embodiment, the interval between the center lines of the rib portions 25 in the left-right direction is substantially the same as the diameter of the fusible toy bead 80 shown in FIG. 6, the left guide portion 30*a* and the right guide portion 30*b* are provided, the rear end surfaces 31*a*2 and 31*b*2 of the plate-shaped guide portions 31*a* and 31*b* are positioned on the further rear side than the rear end (end portion 10*a*) of the spatula portion 20 in the front-rear direction, and the lower surfaces of the plate-shaped guide portions 31*a* and 31*b* are formed into a flat surface continuous with the lower surface 11 of the main body 10. This structure is also similar to the embodiment shown in FIG. 1 and the like.

Figure 14A:
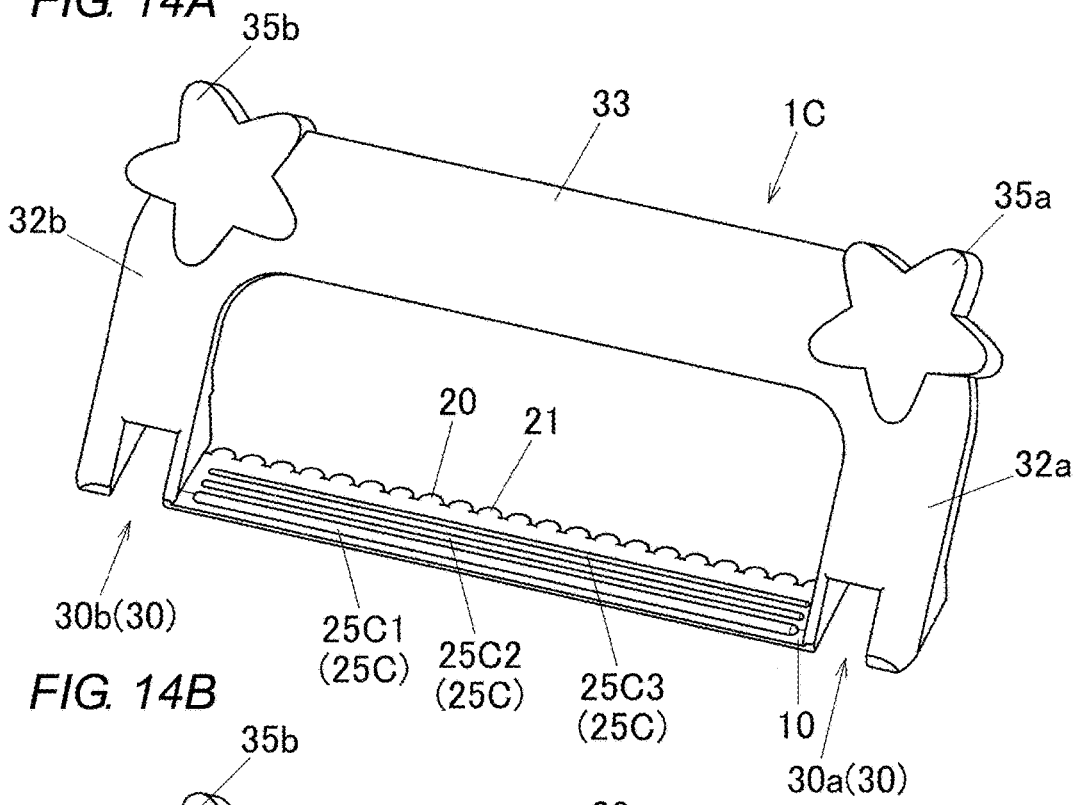
FIGS. 14A and 14B are perspective views showing modified examples of the rib portion of the fusible toy bead scraper according to the embodiment of the present invention.
Figure 14B:
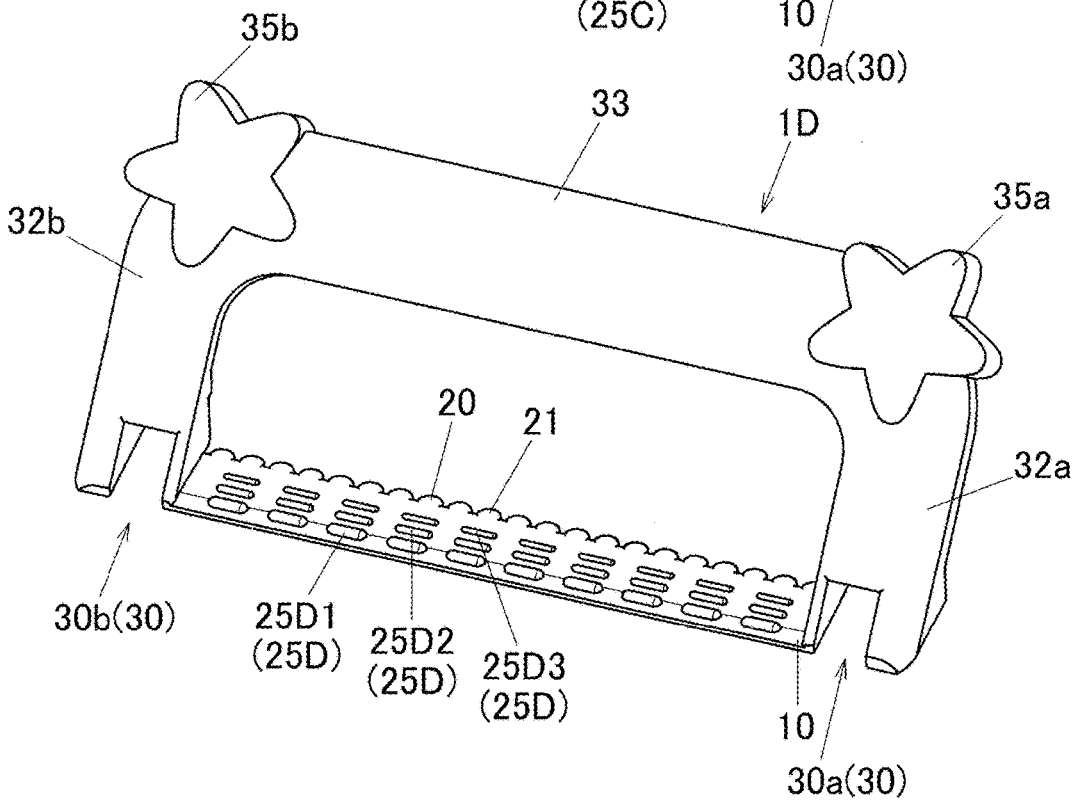

FIGS. 14A and 14B show the fusible toy bead scrapers 1C and 1D in which the rib portions 25 of the fusible toy bead scraper 1 have been modified. In the fusible toy bead scraper 1C shown in FIG. 14A, rib portions 25C formed long in the left-right direction are formed on the upper surface of the main body 10. Three rib portions 25C1, 25C2, and 25C3 are formed in the order from the front side. The rib portions 25C1, 25C2, 25C3 are formed in a semicircular shape in a side view. The diameter of the semicircular shape viewed from the side is set such that the front rib portion 25C1 is formed largest, and the rib portions 25C2 and 25C3 are made smaller in this order. The distance between the rib portions 25C1, 25C2, and 25C3 is set to be equal to or smaller than the diameter of the fusible toy bead 80 in FIG. 6. Accordingly, the rib portions 25C formed in this way can also reduce adhesion of the fusible toy bead 80 to the upper surface of the main body 10 when removing the assembly of the fusible toy beads 80 from the holding tray 50, 60.

Further, as the rib portions 25D in the fusible toy bead scraper 1D shown in FIG. 14B, the rib portions 25C in FIG. 14A can also be arranged intermittently. In this case, the distance between the rib portions 25D1, 25D2, 25D3 in the front-rear direction is set to be equal to or less than the diameter of the fusible toy bead 80, and the distance between the rib portions 25D in the left-right direction (that is, the distance between the rib portions 25D1, the distance between the rib portions 25D2, and the distance between the rib portions 25D3) is set to be equal to or smaller than the diameter of the fusible toy bead 80, whereby it is possible to reduce adhesion of the fusible toy bead 80 to the upper surface of the main body 10 when removing the assembly of the fusible toy beads 80 from the holding tray 50, 60.

Although not shown, the rib portions 25 formed in the front and rear direction of the fusible bead toy scrapers 1, 1A, 1B may be intermittently arranged at intervals equal to or less than the diameter of the fusible toy bead 80.

What is claimed is:

1. A fusible toy bead scraper comprising:

a main body;

a spatula portion provided on a rear side of the main body;

a support portion provided on the main body and extending obliquely rearward from the main body; and a grip portion perpendicularly coupled to the support portion, wherein a guide portion forming a gap configured to guide movement of the spatula portion in a front-rear direction is provided on each of left and right sides of the main body or at least one end of the main body.

2. The fusible toy bead scraper according to claim 1, wherein the spatula portion has a protruding and recessed shape in plan view.

3. The fusible toy bead scraper according to claim 2, wherein the protruding and recessed shape of the spatula portion in plan view has an arc shape.

4. The fusible toy bead scraper according to claim 2, wherein the protruding and recessed shape shape of the spatula portion in plan view comprises a plurality of protruding portions arranged at predetermined intervals.

5. The fusible toy bead scraper according to claim 1, wherein the grip portion extends horizontal from an upper end of the support portion or in the vicinity thereof and is provided substantially parallel to the main body.

6. A fusible toy bead scraper comprising:

a main body;

a spatula portion provided on a rear side of the main body;

a support portion provided on the main body and extending obliquely rearward from the main body; and a grip portion provided on the support portion, wherein the grip portion extends horizontal from an upper end of the support portion or in the vicinity thereof and is provided substantially parallel to the main body, and wherein the support portion is provided on each of left and right sides of the main body and extends obliquely rearward, and the grip portion is provided across the left and right support portions.

7. A fusible toy bead scraper comprising:

a main body;

a spatula portion provided on a rear side of the main body;

a support portion provided on the main body and extending obliquely rearward from the main body; and a grip portion provided on the support portion, wherein a plurality of rib portions upwardly project from an upper surface of the main body.

8. The fusible toy bead scraper according to claim 7, wherein the plurality of rib portions are formed in a front-rear direction or a left-right direction.

9. The fusible toy bead scraper according to claim 7, wherein the rib portion is formed such that a height from a surface of the main body increases toward a direction away from the spatula portion.

10. The fusible toy bead scraper according to claim 7, wherein the rib portion comprises an introduction portion which is formed in a front-rear direction and has a width gradually increasing from a spatula portion side.

11. The fusible toy bead scraper according to claim 7, wherein the spatula portion has a protruding and recessed shape in plan view, and wherein each of the plurality of rib portion are formed to have an elongated shape in a front-rear direction, and the plurality of the rib portions are arranged in a left-right direction, and a center of each of protruding portions in the protruding and recessed shape is aligned with a center of each of the plurality of rib portions.

* * * * *